US008164537B2

(12) United States Patent
Kinezos et al.

(10) Patent No.: US 8,164,537 B2
(45) Date of Patent: Apr. 24, 2012

(54) MULTIBAND FOLDED DIPOLE TRANSMISSION LINE ANTENNA

(75) Inventors: Christos L. Kinezos, Sunrise, FL (US); Ulf Jan-Ove Mattsson, Plantation, FL (US); Lorenzo A. Ponce De Leon, Lake Worth, FL (US)

(73) Assignee: Mororola Mobility, Inc., Libertyville, IL (US)

( * ) Notice: Subject to any disclaimer, the term of this patent is extended or adjusted under 35 U.S.C. 154(b) by 457 days.

(21) Appl. No.: 12/437,448

(22) Filed: May 7, 2009

(65) Prior Publication Data

US 2010/0283688 A1 Nov. 11, 2010

(51) Int. Cl.
*H01Q 9/26* (2006.01)

(52) U.S. Cl. ..... 343/803; 343/702; 343/742

(58) Field of Classification Search ..... 343/700 MS, 343/702, 742, 803
See application file for complete search history.

(56) References Cited

U.S. PATENT DOCUMENTS 4,160,977 A * 7/1979 Davis ..... 343/713
5,198,826 A 3/1993 Ito
5,751,252 A * 5/1998 Phillips ..... 343/726
6,057,803 A * 5/2000 Kane et al. ..... 343/713
6,762,723 B2 7/2004 Nallo et al.
6,822,618 B2 * 11/2004 Bisiules et al. ..... 343/803
6,917,335 B2 * 7/2005 Kadambi et al. ..... 343/700 MS
6,958,735 B2 * 10/2005 Handelsman ..... 343/742
7,176,838 B1 2/2007 Kinezos
7,583,235 B2 * 9/2009 Kim et al. ..... 343/803
2006/0139216 A1 6/2006 Glocker et al.
2007/0040747 A1 2/2007 Kinezos
2007/0085747 A1 4/2007 DiNallo et al.

OTHER PUBLICATIONS

Patent Cooperation Treaty, International Search Report and Written Opinion of the International Searching Authority for International Application No. PCT/US2010/033353, Jul. 26, 2010, 12 pages.

* cited by examiner

*Primary Examiner* — Tho G Phan
(74) *Attorney, Agent, or Firm* — Pablo Meles; Sylvia Chen

(57) ABSTRACT

A multiband folded dipole transmission line antenna (300, 400, 500) including a plurality of concentric-like loops (210, 214, 508) where each loop comprises at least one transmission line element (204, 206) and at least a pair of folded dipole antenna elements (302, 304), a first connection point and a second connection point shared among the plurality of concentric-like loops, and a first inverted L antenna element (216) coupled to the first connection point and a second inverted L antenna element (218) coupled to the second connection point. Additional embodiments are disclosed.

21 Claims, 4 Drawing Sheets

200

300

400

500

600

700

MULTIBAND FOLDED DIPOLE TRANSMISSION LINE ANTENNA

FIELD OF THE DISCLOSURE

This invention relates generally to antennas, and more particularly to a multiband antenna operating on several distinct bands.

BACKGROUND

As wireless devices become exceedingly slimmer and greater demands are made for antennas operating on a diverse number of frequency bands, common antennas such as a Planar Inverted "F" Antenna (PIFA) design becomes impractical for use in such slim devices due to its inherent height requirements. Antenna configurations typically used for certain bands can easily interfere or couple with other antenna configurations used for other bands. Thus, designing antennas for operation across a number of diverse bands each band having a sufficient bandwidth of operation becomes a feat in artistry as well as utility, particularly when such arrangements must meet the volume requirements of today's smaller communication devices.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate the embodiments and explain various principles and advantages, in accordance with the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Figure 1:
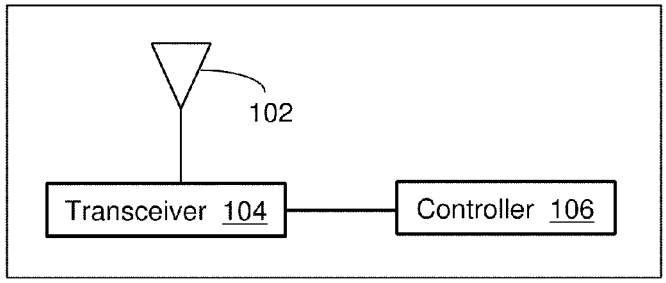
FIG. 1 depicts an embodiment of a communication device in accordance with the present disclosure.

FIG. 1 depicts an exemplary embodiment of a communication device 100. The communication device 100 comprises an antenna 102, coupled to a communication circuit embodied as a transceiver 104, and a controller 106. The transceiver 104 utilizes technology for exchanging radio signals with a radio tower or base station of a wireless communication system according to common modulation and demodulation techniques. Such techniques can include, but is not limited to GSM, TDMA, CDMA, UMTS, WiMAX, WLAN among others. The controller 106 utilizes computing technology such as a microprocessor and/or a digital signal processor with associated storage technology (such as RAM, ROM, DRAM, or Flash) for processing signals exchanged with the transceiver 104 and for controlling general operations of the communication device 100.

One embodiment of the present disclosure can entail a multiband folded dipole transmission line antenna including a big loop resonating at approximately an 850 to 900 MHz range and resonating at approximately an 1800 MHz range, a middle planar inverted F antenna (PIFA) like antenna element residing within the big loop and resonating at approximately a 1900 MHz band and approximately a 3500 MHz band, and two L-type stub elements at the feed and ground plane of the antenna that resonates at two adjacent resonances achieving a minimum of a 200 MHz bandwidth covering approximately a 2.5 GHz band.

Another embodiment of the present disclosure can entail a multiband folded dipole transmission line antenna including a plurality of concentric-like loops where each loop comprises at least one transmission line element and at least a pair of folded dipole antenna elements, a first connection point and a second connection point shared among the plurality of concentric-like loops, and a first inverted L antenna element coupled to the first connection point and a second inverted L antenna element coupled to the second connection point.

Yet another embodiment of the present disclosure can entail a multiband folded dipole transmission line antenna having a common loop among a plurality of loops where the common loop comprises at least a first transmission line element and a second transmission line element coupled to a third transmission line via a first folded dipole element and a second folded dipole element respectively, at least one larger loop comprising the first transmission line element and the second transmission line element and a fourth transmission line element coupled to the first and second transmission line elements via a respective third and fourth folded dipole, and a first L-type stub element coupled to a first connection point between the first folded dipole element and third folded dipole element and a second L-type stub element coupled to a second connection point between the second folded dipole element and the fourth folded dipole element.

Yet another embodiment of the present disclosure can entail a communication device comprising an antenna, a communication circuit coupled to the antenna, and a controller programmed to cause the communication circuit to process signals associated with a wireless communication system. The antenna can include a plurality of concentric-like loops where each loop comprises at least one transmission line element and at least a pair of folded dipole antenna elements, a first connection point and a second connection point shared among the plurality of concentric-like loops, and a first inverted L antenna element coupled to the first connection point and a second inverted L antenna element coupled to the second connection point.

Figure 2:
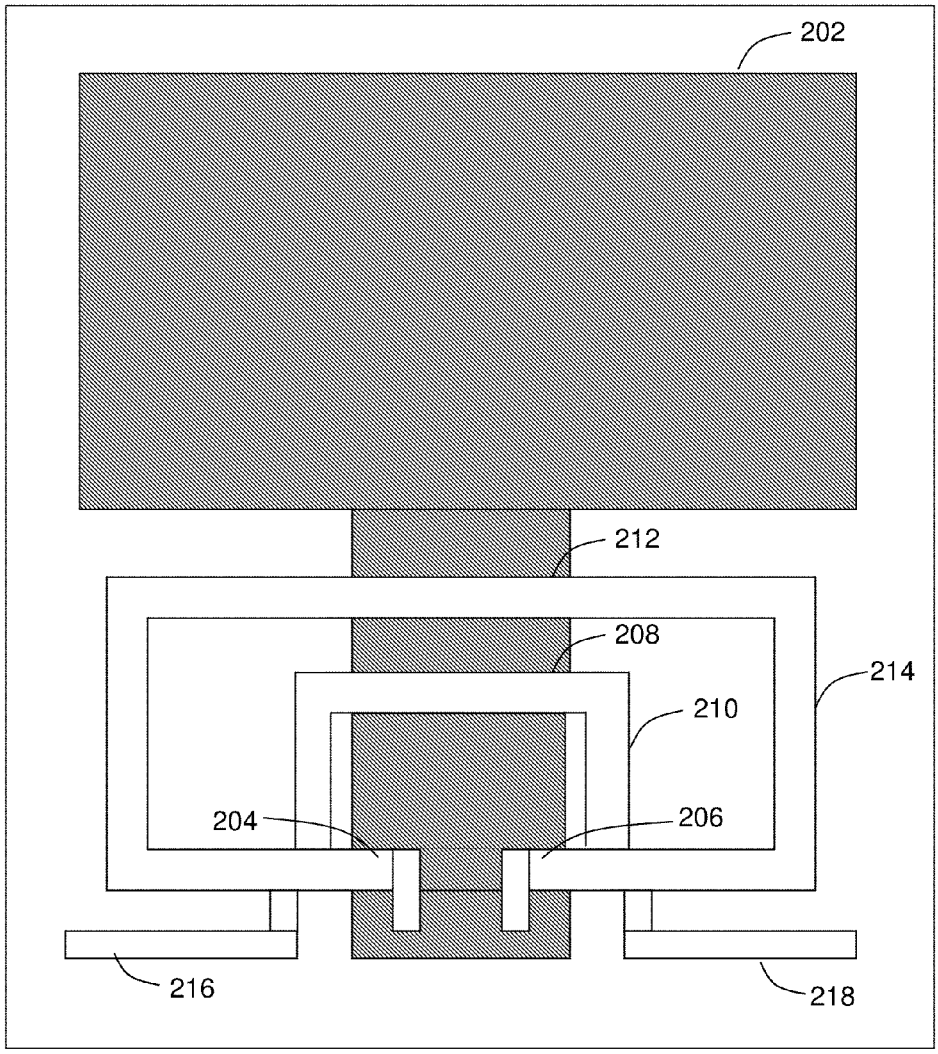
FIG. 2 depicts an exemplary embodiment of a antenna configuration in accordance with the present disclosure.

FIG. 2 depicts a top plane view of a physical model of an antenna 200 which can be used to replace antenna 102 of FIG. 1. The antenna 200 can include a ground plane 202 and a plurality of transmission lines (TLn) that include antenna elements that overlap the ground plane. Such transmission line elements can include elements 204, 206, 208, and 212. Coupling exists between the various sections of the transmission lines and such coupling in the subsequent figures is denoted as "Mn". The open regions where no ground plane overlaps antenna elements are referred to as folded dipole antenna elements "FDn". The folded dipole antenna elements and the respective transmission line elements form "loops". For example, an inner or smaller loop 210 is formed from transmission lines 204, 206, and 208 along with two respective folded dipole antenna elements connecting transmission lines 204 and 206 to transmission line 208. Similarly, a larger or bigger loop is formed from transmission lines 204, 206, and 212 along with two respective folded dipole antenna elements connecting transmission lines 204 and 206 to transmission line 212. The antenna 200 can further include inverted L elements or L shaped stub elements 216 and 218 designated as "ILAn". As will be seen in subsequent figures, connection points between the folded dipole elements FDn, inverted L elements, and transmission lines will be designated as "Cn".

Figure 3:
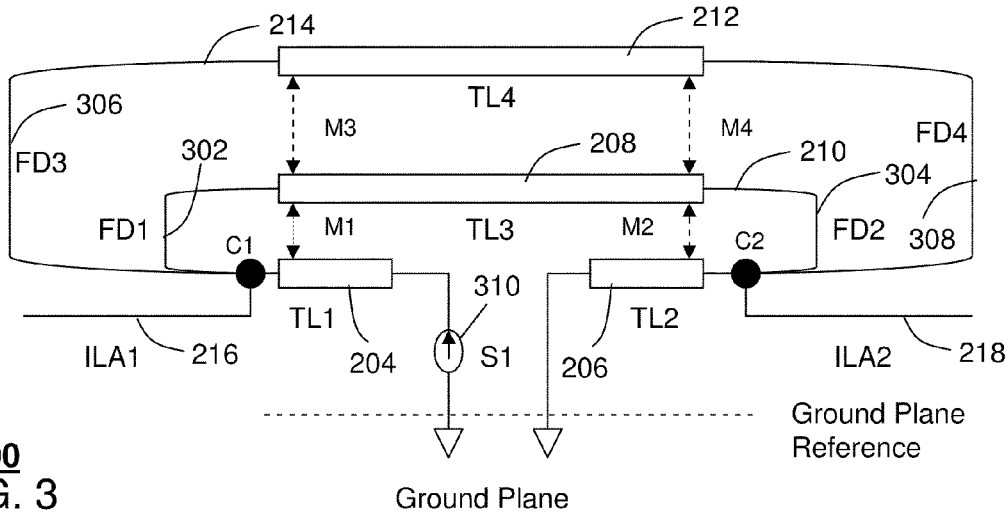
FIG. 3 depicts an electrical diagram of an antenna of the communication device of FIG. 2.

FIG. 3 is an electrical model representation 300 of the physical model of the antenna 200 FIG. 2. As in antenna 200, this antenna 300 includes a plurality of transmission line antenna elements, folded dipole antenna elements, and inverted L elements. More particularly, antenna 200 includes transmission lines 204, 206, and 208 coupled by respective folded dipole elements 302 (FD1) and 304 (FD2) that in combination form the concentric-like inner loop 210. Another concentric-like bigger loop 214 is formed from transmission lines 204, 206, and 212 coupled by respective folded dipole antenna elements 306 (FD3) and 308 (FD4). The antenna 200 can further include the inverted L elements or L shaped stub elements 216 (ILA1) and 218 (ILA2). A common point between the folded dipole elements 302 or FD1, 306 or FD3, inverted L element 216 or ILA1, and transmission lines 204 (TL1), 208 (TL3), and 212 (TL4) forms connection point C1. Similarly, a common point between the folded dipole elements 304 or FD2, 308 or FD4, inverted L element 218 or ILA2, and transmission lines 206 (TL2), 208 (TL3), and 212 (TL4) forms connection point C2. Further note that a radiation transduction signal S1 or 310 is created by folded dipole elements and currents in the ground plane. The location of inverted L-elements ILA1 and ILA2 and the respective connection points C1 and C2 can be rotated along the perimeter of outer loop 214. Furthermore, inverted elements ILA1 and ILA2 can be constructed as meander lines.

Figure 4:
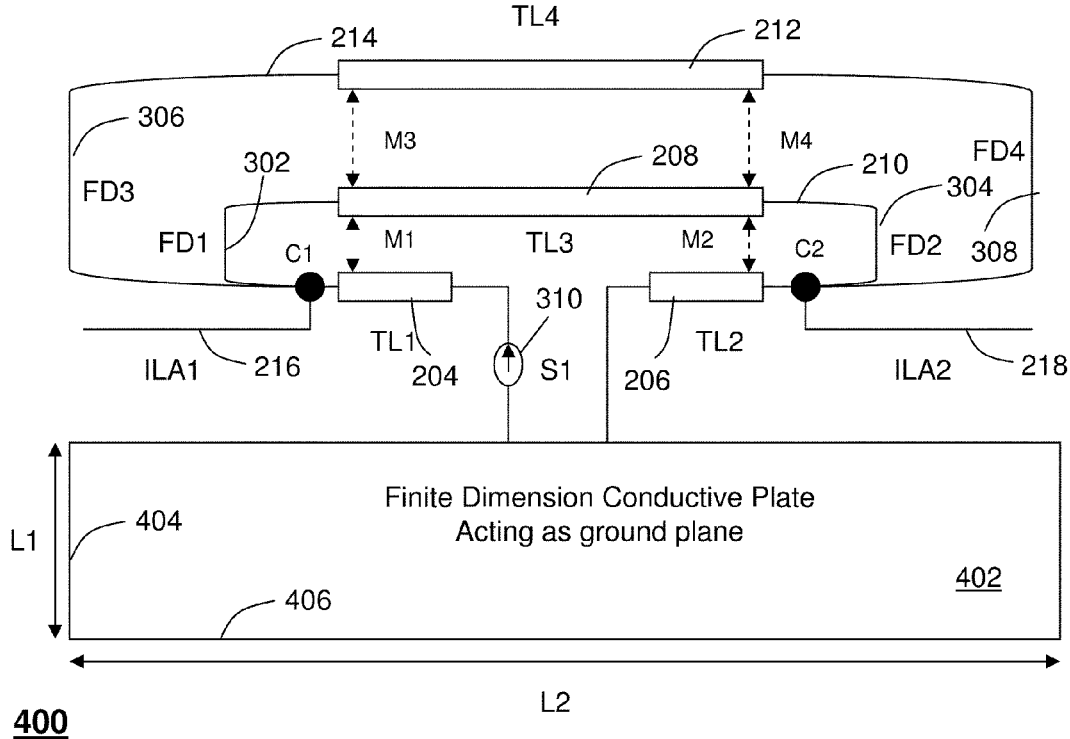
FIG. 4 depicts an electrical diagram of an antenna configuration having a finite dimension conductive plate acting as a ground plane in accordance with an embodiment of the present disclosure.

Referring to FIG. 4, an antenna arrangement 400 very similar to antenna 300 of FIG. 3 is illustrated showing a second electrical model that further includes a finite dimension conductive plate 402 acting as a ground plane. The plate 402 includes plate dimensions 402 (L1) and 406 (L2). The plate dimensions 402 and 406 or L1 and L2 can be designed to be near a quarter wavelength or larger at a lowest frequency of operation. Portions of the antenna structure overlap the plate 402 to form the transmission lines TL1, TL2, TL3, and TL4. Portions of the antenna structure that do not overlap the plate form folded dipole elements FD1, FD2, FD3, and FD4.

Figure 5:
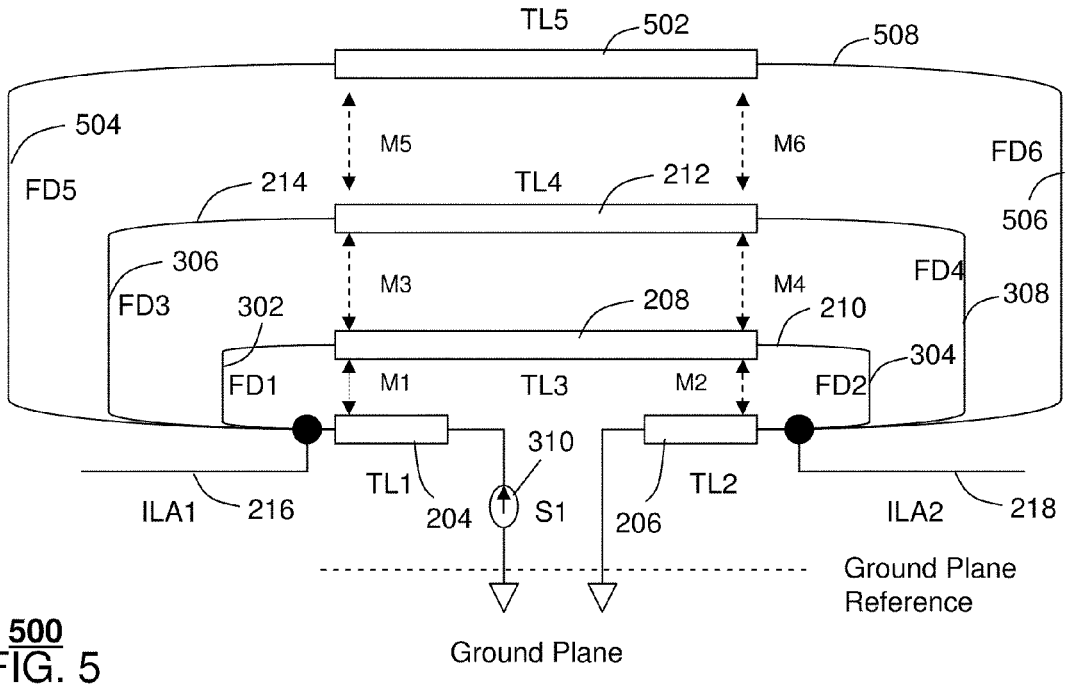
FIG. 5 depicts an electrical diagram of yet another antenna configuration having multiple concentric-like loops in accordance with an embodiment of the present disclosure.

Referring to FIG. 5, another antenna arrangement 500 very similar to antenna 300 of FIG. 3 is illustrated to show that the antenna topology can be expanded by symmetry to include more elements which will produce band. In other words, this can include additional concentric-like loops. In this example, one additional loop 508 is illustrated formed from transmission lines 204, 502 (TL5), and 206 and folded dipole antenna elements 504 (FD5) and 506 (FD6). Further note that coupling M1 exists between transmission lines 204 and 208, coupling M2 exists between transmission lines 206 and 208, coupling M3 and M4 exists between transmission lines 208 and 212, and coupling M5 and M6 exists between transmission lines 212 and 502 as illustrated.

In terms of theory of operation and with reference to FIGS. 2-4, various antenna elements, structures or components control resonance frequencies for certain bands or even provide a particular bandwidth. For example, the overall electrical length of TL1-FD3-TL4-FD4-TL2 (or the bigger loop) controls the resonance frequency of the lower bands. The overall electrical length of TL1-FD1-TL3-FD2-TL2 (or the inner loop) controls the resonance frequency of the higher bands. The coupling M1-M2-M3-M4 controls the bandwidth within the resonant frequency bands. Furthermore, TL1-TL2 control the feed point impedance of the antenna. Radiation transduction of signal S1 (310) is created by folded dipole elements and currents in ground plane. The elements inverted L antenna elements ILA1,2 couple to the antenna structure at C1,2 and add additional radiating bands of operation. Also, as noted above, the embodiments can be symmetrical in structure where the transmission lines TL1=TL2, the folded dipoles FD1=FD2 and FD3=FD4, and the coupling M1=M2 and M3=M4. Also, the inverted L antenna elements can equal each other as ILA1=ILA2

The configurations described herein can provide for a compact single element multi-band internal antenna that covers 4 GSM bands (850 MHz, 900 MHz, 1800 MHz, 1900 MHz for example) and both domestic and International WiMAX bands (2.5 GHz and 3.5 GHz) with sufficient spherical efficiency to meet all required internal and customer radiation requirements for US and the rest of the world. Thus, the antenna configurations described can serve as a quad-band GSM dual band WiMax antenna.

Figure 6:
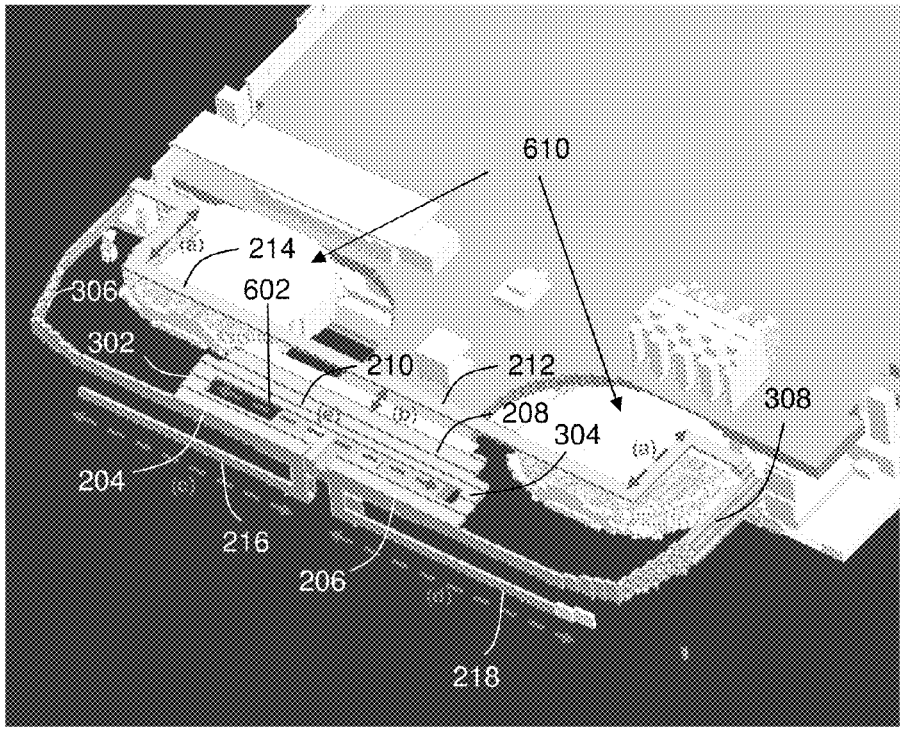
FIG. 6 is a perspective view of an antenna configuration in accordance with an embodiment of the present disclosure.

Referring to FIGS. 1 and 6, a perspective view of an embodiment of antenna 102 of the communication device 100 is shown in FIG. 6 supported by a substrate such as a printed circuit board (PCB) and is shown as the antenna arrangement 600. A ground plane of the antenna arrangement can be included as one layer of the PCB extending throughout most of the PCB. Alternatively, the ground 202 can be arranged in several layers of the PCB with similar extensions throughout the PCB. The PCB can be used to support and interconnect other electrical components of the communication device 100 such as the transceiver 104 and the controller 106. For any of the foregoing embodiments, the PCB can be a rigid (e.g., FR-4) or flexible (e.g., Kapton) substrate for example.

The geometry of the antenna arrangement 600 in FIG. 6 is configured for a Multi-slider phone. The antenna can be made either of a sheet metal or can be insert molded using a 2-shot method. As noted above, the antenna arrangement can comprise of a big loop (that resonates at 850/900 and 1800 MHz) that includes folded dipoles 306 and 308 as well as transmission lines 204, 206, and 212, a middle element metal with a slot 602 (responsible for 1900 and 3500 bands) and two L-type stubs 216 and 218 at the feed and the ground (can produce 2 separate resonances adjacent to each other to achieve a minimum of 200 MHz of bandwidth to cover the 2.5 GHz WiMAX resonance).

Figure 7:
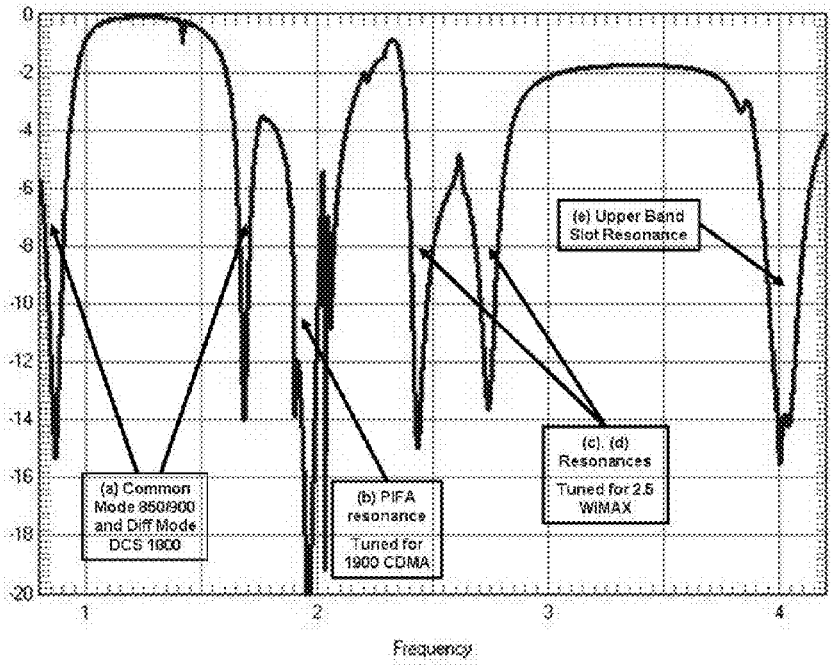
FIG. 7 is a sample return loss graph for the antenna configuration of FIG. 6.

The antenna configuration shown in FIG. 6 illustrates an instance where the openings of the antenna structures can be designed to have multiple uses. The openings within the antenna structure shown in FIG. 6 are designed to allow a pair of audio transducers 610 to share the air volume with the antenna elements 212 and 214 and operate without interfering with the radiation transduction of the antenna. In order to minimize interaction between the audio transducers 610 and the antenna, the audio transducers 610 are decoupled from the electrical signal lines that drive the transducers. In other embodiments input and/or output device or devices such as USB connectors can reside inside the antenna volume. In a preferred embodiment, the input and/or output device or devices are decoupled from the signal lines that drive the device. In general, the design offers flexibility in placement of the antenna in relation to the input and or output device or devices and any element of the antenna structure can overlap the input and or output device or devices Referring to FIG. 7, a return loss chart 700 can illustrate how certain structures can be tuned or constructed to provide a desired operational performance. For example, the length "a" can control a common mode of operation in the 850 to 900 MHz range as well as a differential mode for the DCS 1800 MHz band range. The distance "b" between transmission line elements 208 and 212 can control the antenna element resonance which can be tuned for 1900 CDMA operation for example. The length for "c" and "d" can control resonances for a 2.5 GHz WiMax system for example. Also, the slot length "e" can be tune or constructed to control an Upper Band slot resonance (for 3.5 GHz WiMax or 5 GHz WLAN for example.) As can be noted above, there are a number of variables in the illustrations that can affect the spectral performance of the antennas herein.

The foregoing embodiments of the antennas illustrated herein provide a multiband antenna design with a wide operating bandwidth where desired. The specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The embodiments herein are defined solely by the appended claims including any amendments made during the pendency of this application and all equivalents of those claims as issued.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A multiband folded dipole transmission line antenna, comprising:

a big loop resonating at approximately an 850 to 900 MHz range and resonating at approximately an 1800 MHz range;

a middle loop residing within the big loop and resonating at approximately a 1900 MHz band and approximately a 3500 MHz band; and two L-type stub elements at the feed and ground plane of the antenna that resonates at two adjacent resonances achieving a minimum of a 200 MHz bandwidth covering approximately a 2.5 GHz band.

2. The antenna of claim 1, wherein the middle loop includes a metal element with a slot.

3. The antenna of claim 2, wherein the slot can be tuned to cover one among a 3.5 MHz WiMAX range and a 5 GHz WLAN range.

4. The antenna of claim 1, wherein the antenna comprises a plurality of transmission line elements and folded dipole elements forming the big loop and the middle loop.

5. The antenna of claim 4, wherein the overall electrical length of the transmission line elements and folded dipole elements of the big loop controls a resonant frequency of lower operating bands.

6. The antenna of claim 4, wherein the overall electrical length of the transmission line elements and folded dipole elements of the middle loop controls a resonant frequency of higher operating bands.

7. The antenna of claim 1, wherein coupling between transmission line elements control resonant frequency bands.

8. The antenna of claim 1, wherein L-type stub elements control a feed point impedance of the antenna.

9. The antenna of claim 1, wherein a radiation transduction of a signal S1 is created by folded dipole elements and currents in a ground plane.

10. The antenna of claim 1, wherein the antenna has a symmetrical structure in terms of transmission line elements, folded dipole elements, L-type stub elements and coupling between transmission line elements.

11. The antenna of claim 1, wherein the antenna overlaps one or multiple input and/or output devices.

12. The antenna of claim 11, wherein the input and/or output device or devices are decoupled from signal lines that drive the device or devices.

13. The antenna of claim 12, wherein the output device is a pair of audio transducers.

14. A multiband folded dipole transmission line antenna, comprising:

a first loop with at least a first transmission line element and at least a first pair of folded dipole antenna elements;

a second loop residing within the first loop with at least a second transmission line element and at least a second pair of folded dipole antenna elements;

a first connection point and a second connection point shared between the first loop and the second loop; and a first inverted L antenna element coupled to the first connection point and a second inverted L antenna element coupled to the second connection point.

15. The antenna of claim 14, wherein the at least the first transmission line element and the at least the second transmission line element are arranged and constructed to have a predetermined coupling between the at least the first transmission line element and the at least the second transmission line element.

16. The antenna of claim 14, wherein the at least the first pair of folded dipole elements and the at least the second pair of folded dipole antenna elements are located in open regions where no ground plane overlaps antenna elements.

17. The antenna of claim 14, wherein the antenna further comprises:

a finite conductive plate serving as a ground plane having dimensions L1 and L2 to be approximately one-quarter wave length at the lowest frequency of operation.

18. The antenna of claim 14, wherein the at least the first transmission line element and the at least the first pair of folded dipole elements have symmetrical dimensions.

19. The antenna of claim 14, wherein the antenna is a quad-band GSM, Dual band WiMAX antenna.

20. A multiband folded dipole transmission line antenna, comprising:

a first loop, wherein the first loop comprises at least a first transmission line element and a second transmission line element coupled to a third transmission line element via a first folded dipole element and a second folded dipole element respectively;

a second loop that is larger than the first loop, comprising the first transmission line element and the second transmission line element and a fourth transmission line element coupled to the first and second transmission line elements via a respective third and fourth folded dipole;

a third loop that is smaller than the first loop, comprising the first transmission line element and the second transmission line element and a fifth transmission line element coupled to the first and second transmission line elements via a respective fifth and sixth folded dipole; and a first L-type stub element coupled to a first connection point between the first folded dipole element and third folded dipole element and a second L-type stub element coupled to a second connection point between the second folded dipole element and the fourth folded dipole element.

21. A communication device, comprising:

an antenna;

a communication circuit coupled to the antenna; and a controller programmed to cause the communication circuit to process signals associated with a wireless communication system, and wherein the antenna comprises:

a first loop, wherein the first loop comprises at least one transmission line element and at least a pair of folded dipole antenna elements;

a second loop residing within the first loop;

a first connection point and a second connection point shared among the first loop and the second loop; and a first inverted L antenna element coupled to the first connection point and a second inverted L antenna element coupled to the second connection point.

* * * * *